US011849860B2

(12) United States Patent
Neil et al.

(10) Patent No.: US 11,849,860 B2
(45) Date of Patent: Dec. 26, 2023

(54) CHAIR BACK ADJUSTMENT SYSTEM

(71) Applicant: ALLSEATING CORPORATION, Mississauga (CA)

(72) Inventors: Gary Neil, Mississauga (CA); Marco Paesano, Oakville (CA); David Nicoll, Mississauga (CA)

(73) Assignee: ALLSEATING CORPORATION, Mississauga (CA)

( * ) Notice: Subject to any disclaimer, the term of this patent is extended or adjusted under 35 U.S.C. 154(b) by 0 days.

(21) Appl. No.: 17/577,534

(22) Filed: Jan. 18, 2022

(65) Prior Publication Data

US 2023/0225513 A1 Jul. 20, 2023

(51) Int. Cl.
*A47C 7/40* (2006.01)

(52) U.S. Cl.
CPC ..... *A47C 7/402* (2013.01)

(58) Field of Classification Search
CPC ..... A47C 7/402
USPC ..... 297/440.2, 354.1
See application file for complete search history.

(56) References Cited

U.S. PATENT DOCUMENTS 6,092,871 A * 7/2000 Beaulieu ..... A47C 7/462 297/284.4
7,063,384 B2 * 6/2006 Liu ..... A47C 7/40 297/285
7,731,286 B2 * 6/2010 Wu ..... A47C 7/462 297/301.7
8,544,957 B2 * 10/2013 Lin ..... 297/301.7

* cited by examiner

*Primary Examiner* — Anthony D Barfield
(74) *Attorney, Agent, or Firm* — Bennett Jones LLP

(57) ABSTRACT

A back adjustment system for a chair having a frame that includes a top end and bottom end. The back adjustment system may further, include a chair back having a first end and a second end. The first end of the chair back may be mounted solely to the top end of the frame of the chair and also includes an adjusting means, which may be mounted at the bottom end of the frame. The adjusting means may allow for engagement between the bottom end of the frame and the second end of the chair back. The adjusting means may be adapted to telescopically engage between the bottom end of the frame and the second end of the chair back thereby solely moving the second end of the chair back from a retracted position to an extended position.

7 Claims, 10 Drawing Sheets

CHAIR BACK ADJUSTMENT SYSTEM

FIELD OF THE INVENTION

This invention relates in general to adjustment mechanisms for chairs and more particularly a back adjustment system for a chair and more specifically the movement of a chair back.

BACKGROUND OF THE INVENTION

There are wide variety of office chairs that have been designed to be more ergonomic and provide a variety of different functions and adjustments. These adjustments are typically in relation to height of the chair seat or arm positioning, and more specifically chair back support for the spine and the back, which are susceptible to the harmful effects of a prolonged sitting position. In general, chair have included adjustments to the height of the chair back itself so that the spinal support can be adjusted relative to the height of the individual. Other adjustment mechanisms have focused on adjusting the depth of spinal support, which can be accomplished by adjusting the chair back itself. Many of the adjustment mechanisms include complex arrangements and require the user to reach under the chair seat and do not provide an easy accessible adjustment mechanism or steady support.

A back adjustment system for chair back that focuses on the chair back, which is easy for the individual to adjust, maintains the ergonomics of the chair back, provides improved spinal support, allows for support along a horizontal plane by adjusting the entire chair back is desirable.

SUMMARY OF THE INVENTION

An object of one aspect of the present invention is to provide a chair back adjustment system.

In accordance with one aspect of the present invention there is provided a back adjustment system for a chair having a frame that includes a top end and bottom end. The back adjustment system may further include a chair back having a first end and a second end. The first end of the chair back may be mounted solely to the top end of the frame of the chair.

The back adjustment system for a chair may further include an adjusting means, which may be mounted at the bottom end of the frame. The adjusting means may allow for engagement between the bottom end of the frame and the second end of the chair back. The adjusting means may be adapted to telescopically engage between the bottom end of the frame and the second end of the chair back thereby solely moving the second end of the chair back from a retracted position to an extended position.

Preferably, the adjusting means may further include a ratchet assembly that extends from the mid point of the bottom end of the frame outwards along a horizontal plane. The ratchet assembly may allow for the second end of the chair back to move outwards away from the frame.

Conveniently, the adjusting mechanism may include a adjustment mechanism which may be actuated by a least one push button positioned on the second end on the chair back.

BRIEF DESCRIPTION OF THE DRAWINGS

A detailed description of the preferred embodiment is provided herein below by way of example only and with reference to the following drawings, in which.

Figure 1:
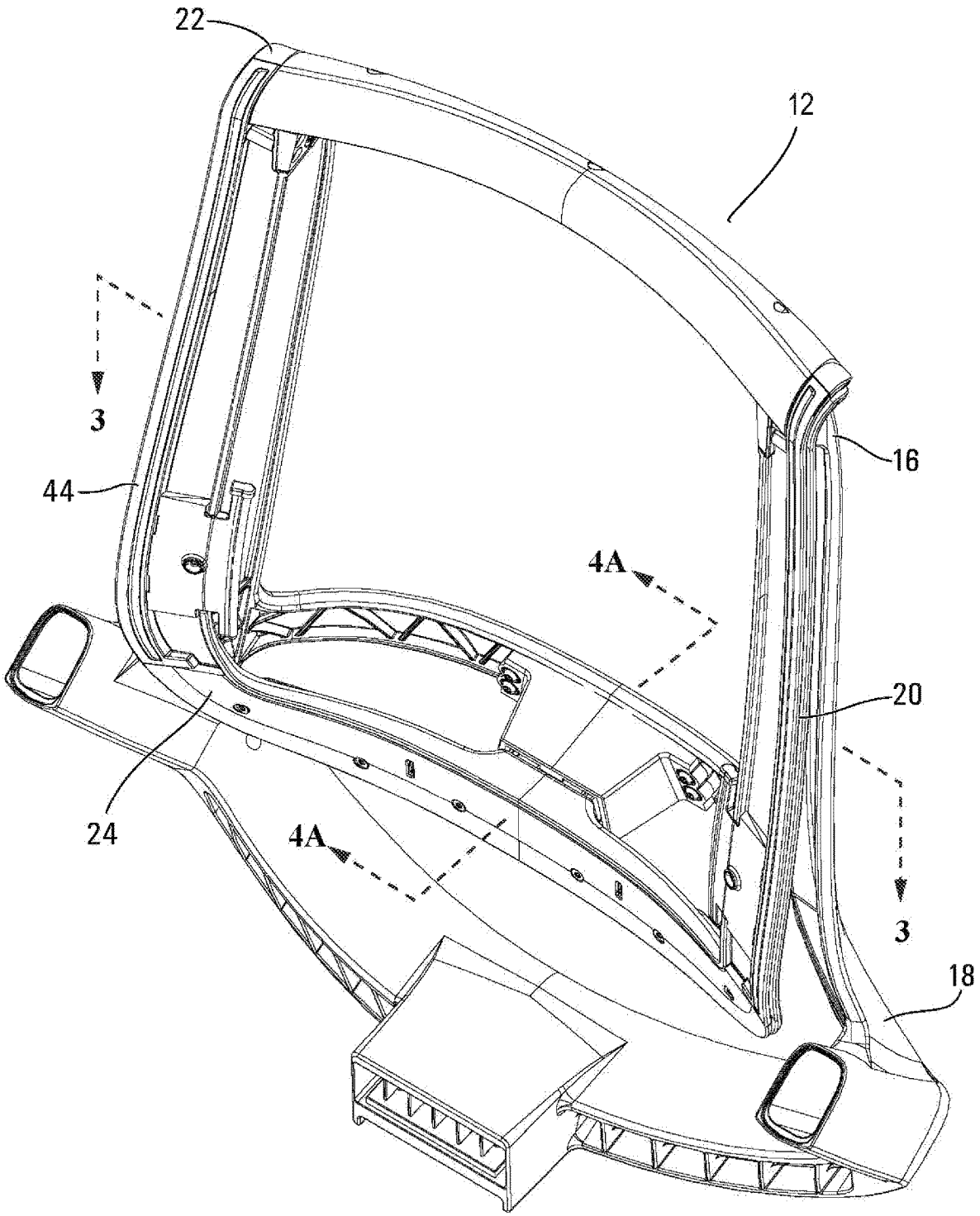
FIG. 1 is a perspective view and illustrates a back adjustment system for a chair in accordance with the preferred embodiment of the present invention.
Figure 2:
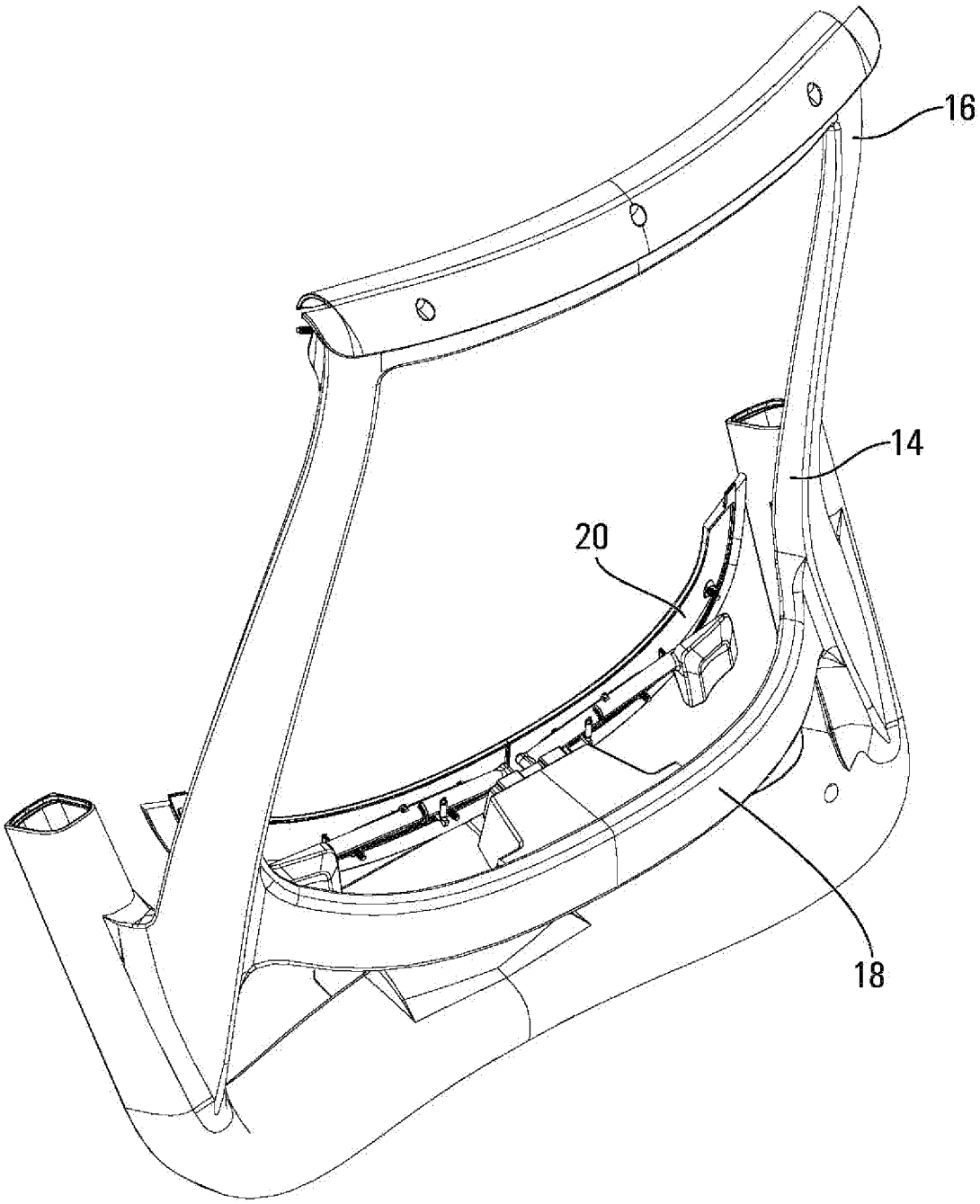
FIG. 2 in a back perspective view, illustrates the back adjustment system for a chair of FIG. 1.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENT

Referring to FIGS. 1 to 7*b*, there is illustrated a back adjustment system 10 for a chair 12 in accordance with a preferred embodiment of the present invention. The back adjustment system 10 for a chair 12 includes a frame 14 including a top end 16 and bottom end 18 and a chair back 20 having a first end 22 and a second end 24 where the first end 22 of the chair 20 back is mounted solely to the top end 16 of the frame 14.

Figure 7B:
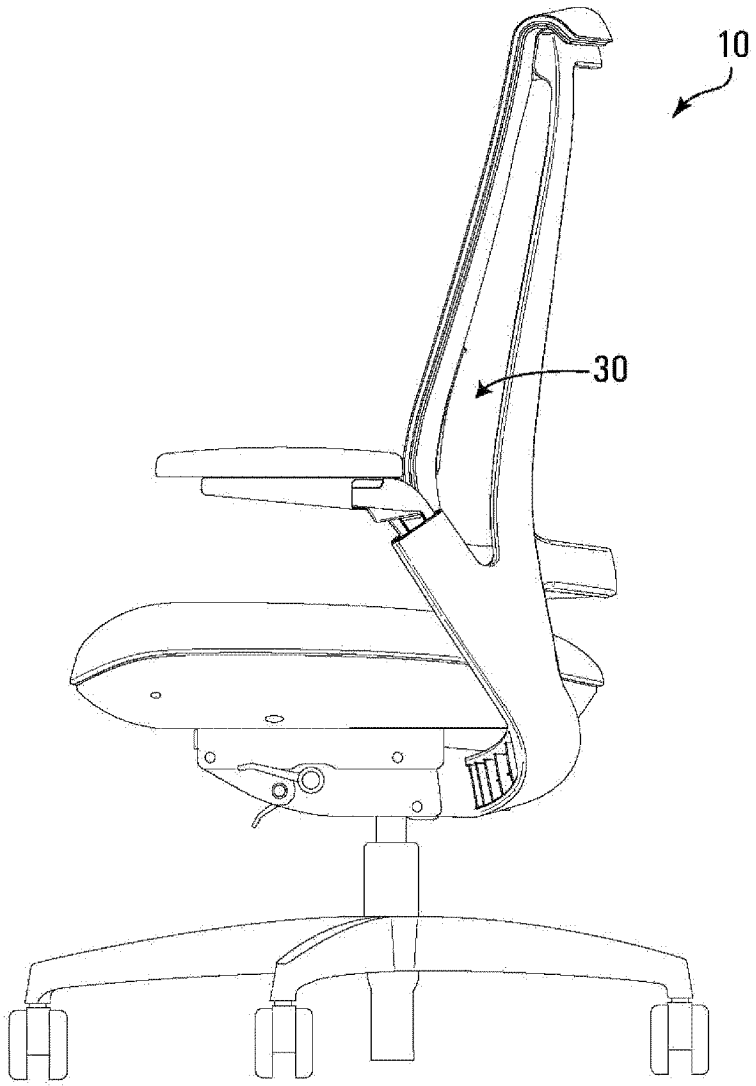
FIG. 7*b* in a side view, illustrates the back adjustment system for a chair of FIG. 1.
Figure 7A:
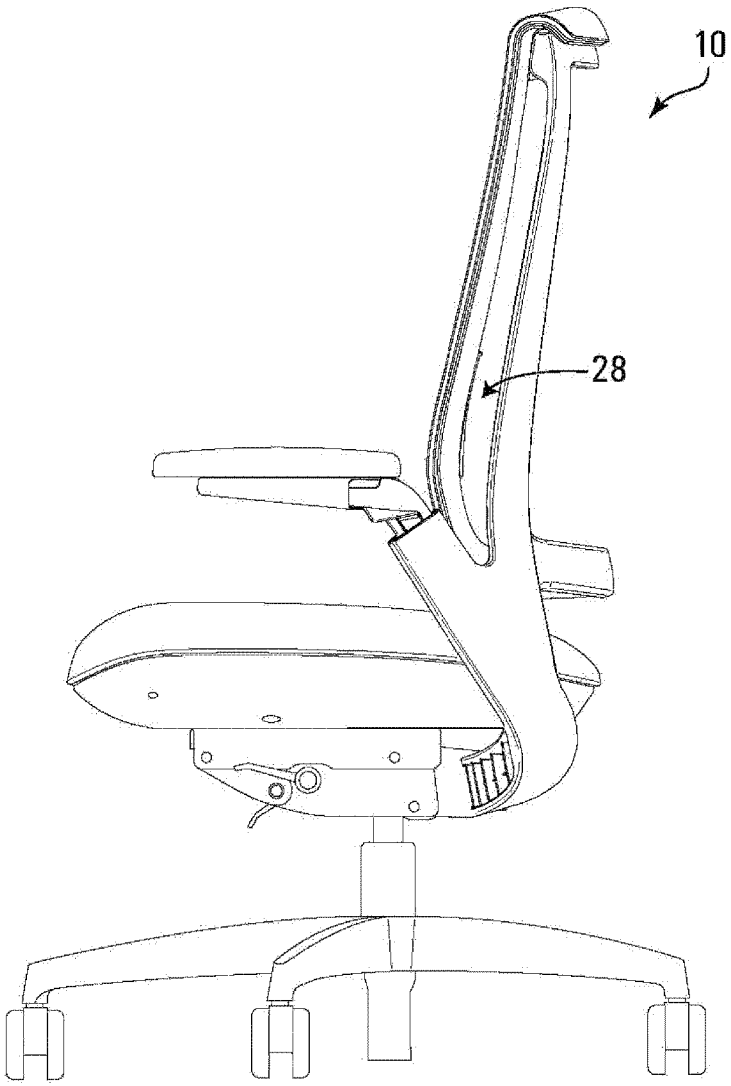
FIG. 7*a* in a side view, illustrates the back adjustment system for a chair of FIG. 1.

An adjusting means 26 may be mounted at the bottom end 18 of the frame 14 for engagement between the bottom end 18 of the frame 14 and the second end 24 of the chair back 20. The adjusting means 26 may be adapted to telescopically engage between the bottom end 18 of the frame 14 and the second end 24 of the chair back 20. Referring to FIGS. 7*a* and 7*b*, this configuration may allow for the sole movement of the second end 24 of the chair back 20 from a retracted position 28 to an extended position 30.

The frame 14 may be configured to mirror the shape of the chair back 20 whereby the frame 14 is not visible when positioned in front of the chair 12. The frame 14 may be made from a variety of materials including metal and plastic, by way of example only.

The chair back 20 may be configured into a variety of shapes that provide support for a user when seated in the chair 12. In particular, the top end 22 of the chair back 20 securely engages with the top end 16 of the frame 14. More specifically the chair back 20 and the frame 14 only engage with one another directly at the top end 22 of the chair back 20. The secure engagement between the top end 22 of the chair back 20 and top end 16 of the frame 14 occurs with the aid of fasteners and or adhesives, while allowing flexibility and movement in the chair back 20 itself at its second end 24.

More specifically the chair back 20 can flex along its horizontal and vertical plane or in, an angular pivoting motion thereby providing varying support for the user in the chair 12. The chair back 20 may further include a lumbar zone 40 that moves with the chair back to provide support to user in various positions. The chair back 20 may further include a covering, such as an upholstered covering or mesh covering, by way of example only.

Figure 3:
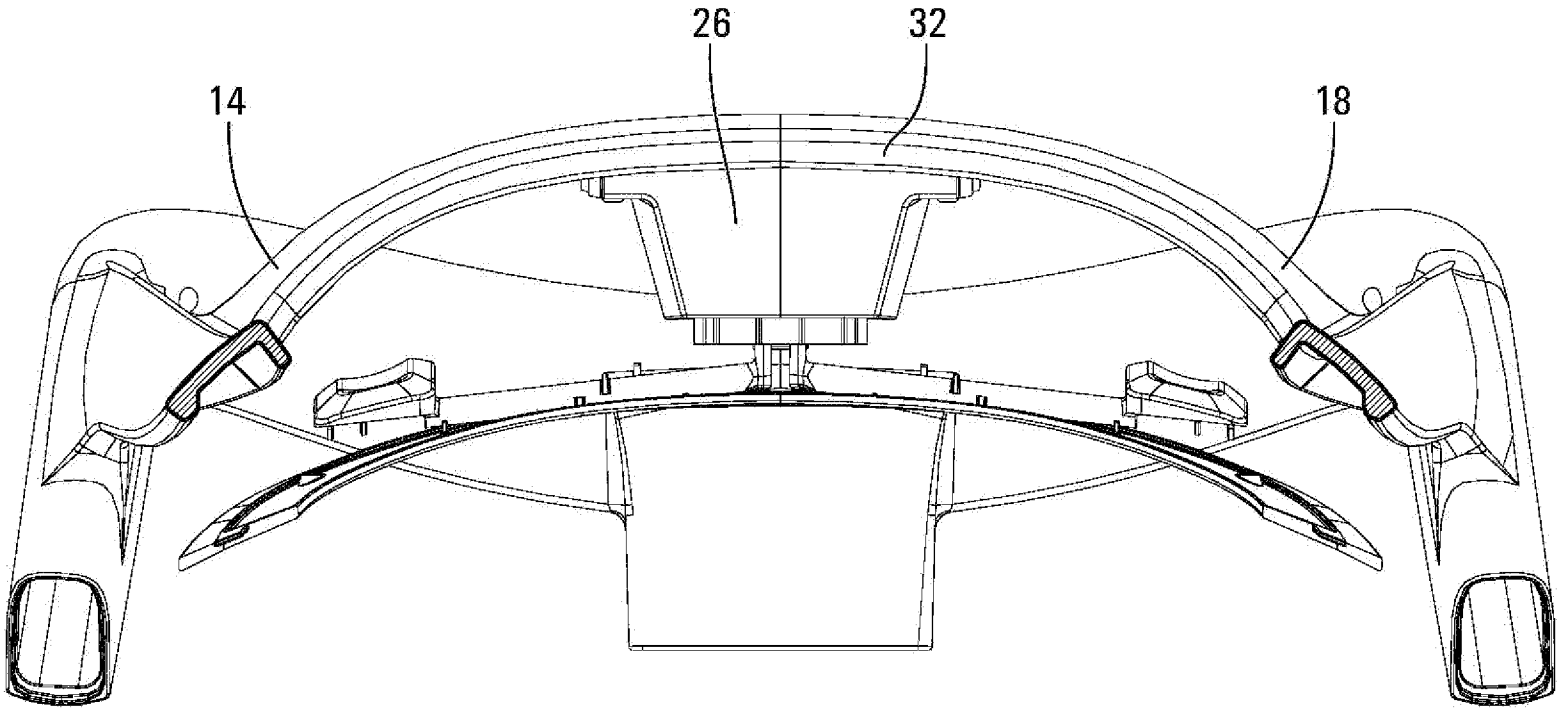
FIG. 3 in a top view, illustrates the back adjustment system for, a chair of FIG. 1.
Figure 4A:
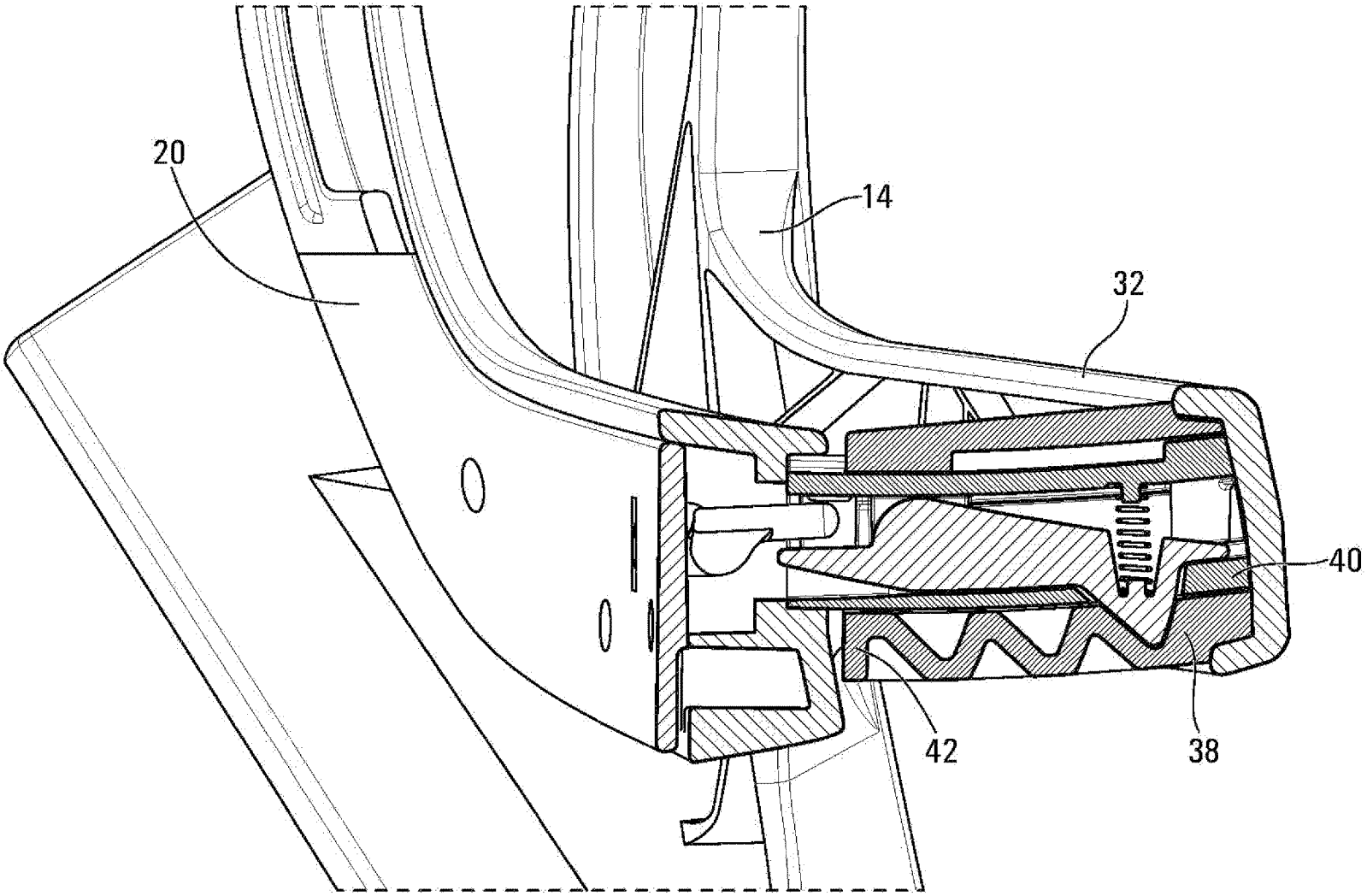
FIG. 4*a* in a cross sectional view along the lines 4-4, illustrates the back adjustment system for a chair of FIG. 1.
Figure 4B:
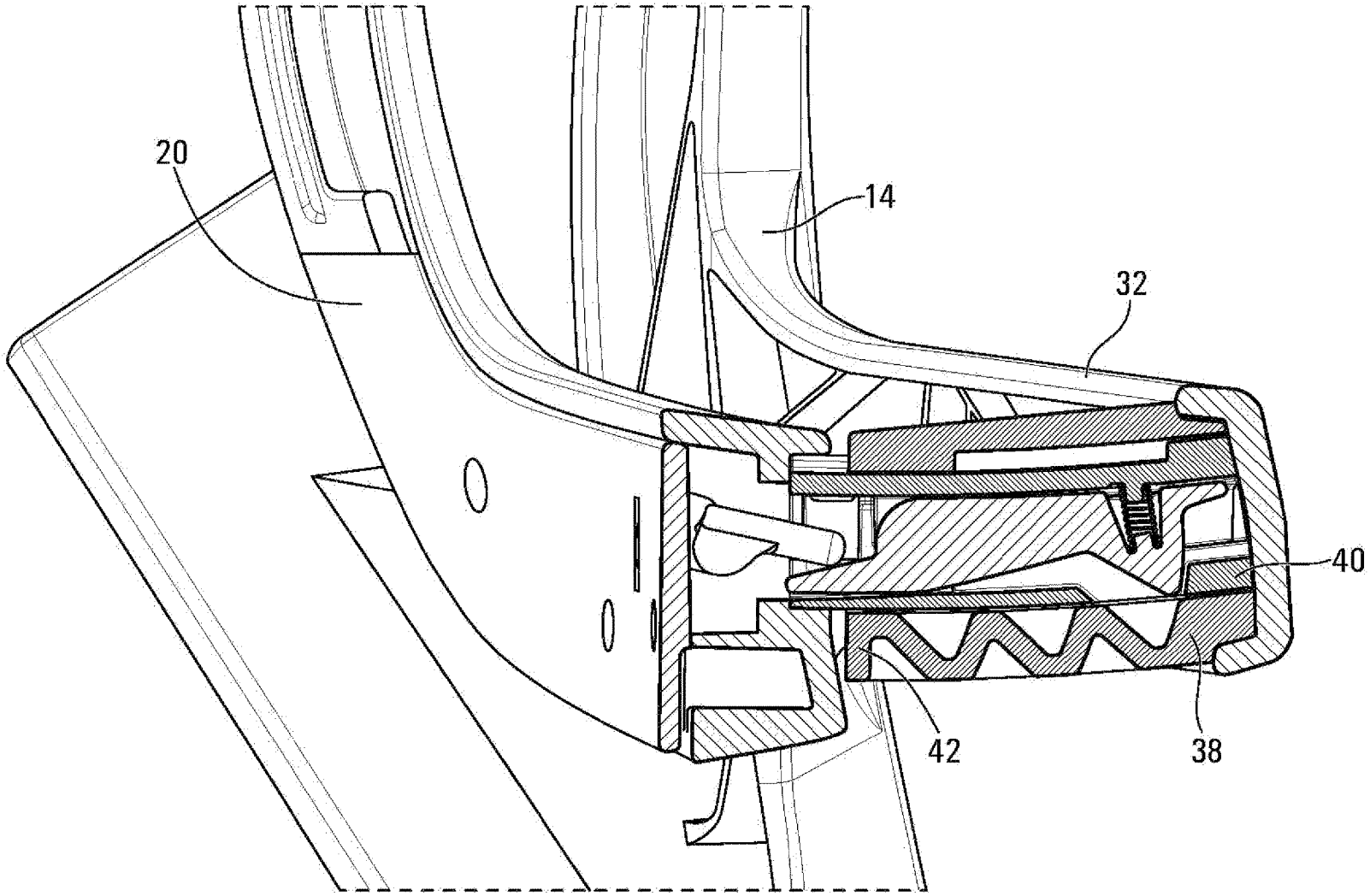
FIG. 4*b* in a-cross sectional view along the lines 4-4, illustrates the back adjustment system for a chair of FIG. 1.
Figure 4C:
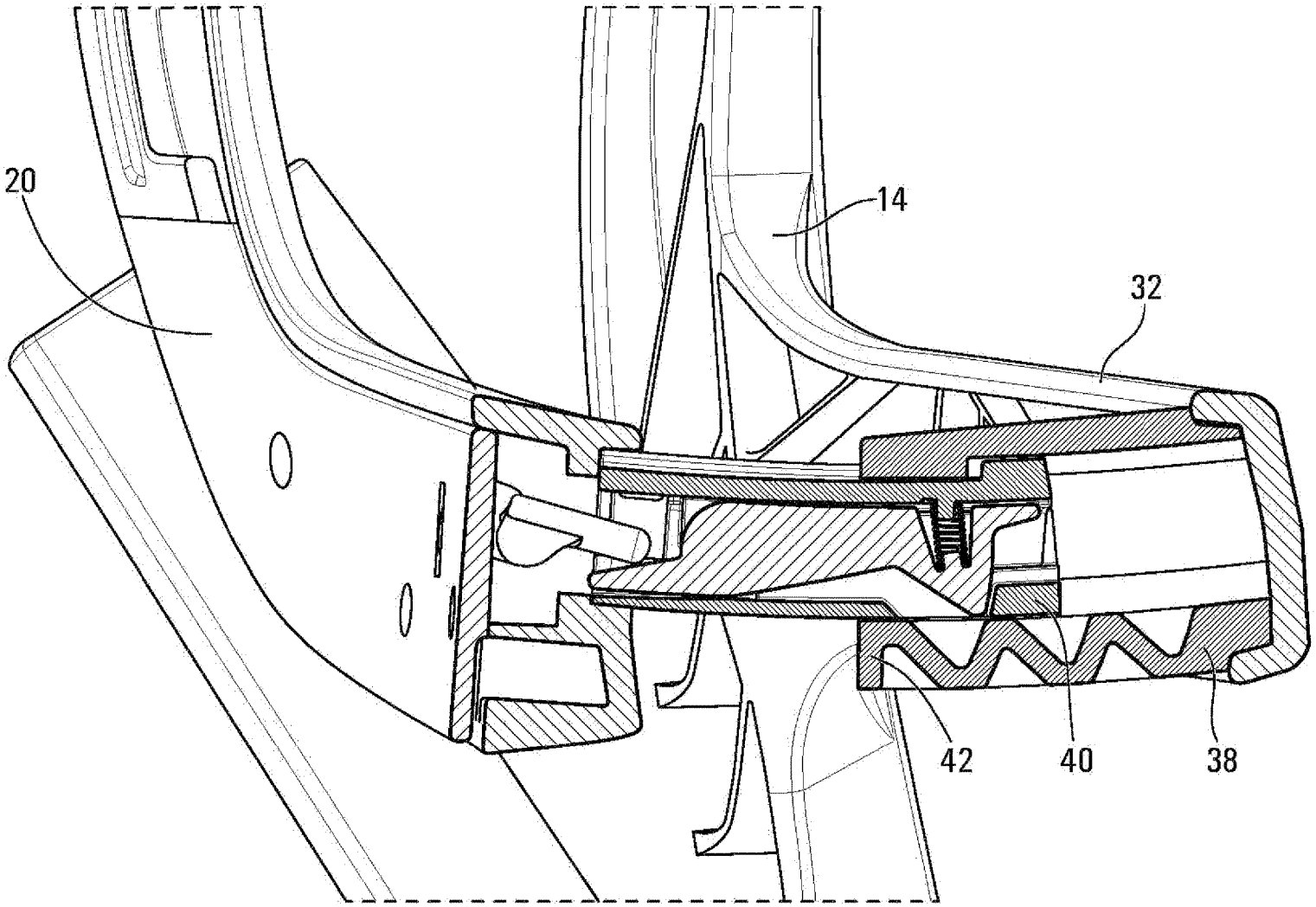
FIG. 4*c* in a cross sectional view along the lines 4-4, illustrates the back adjustment system for a chair of FIG. 1.
Figure 4D:
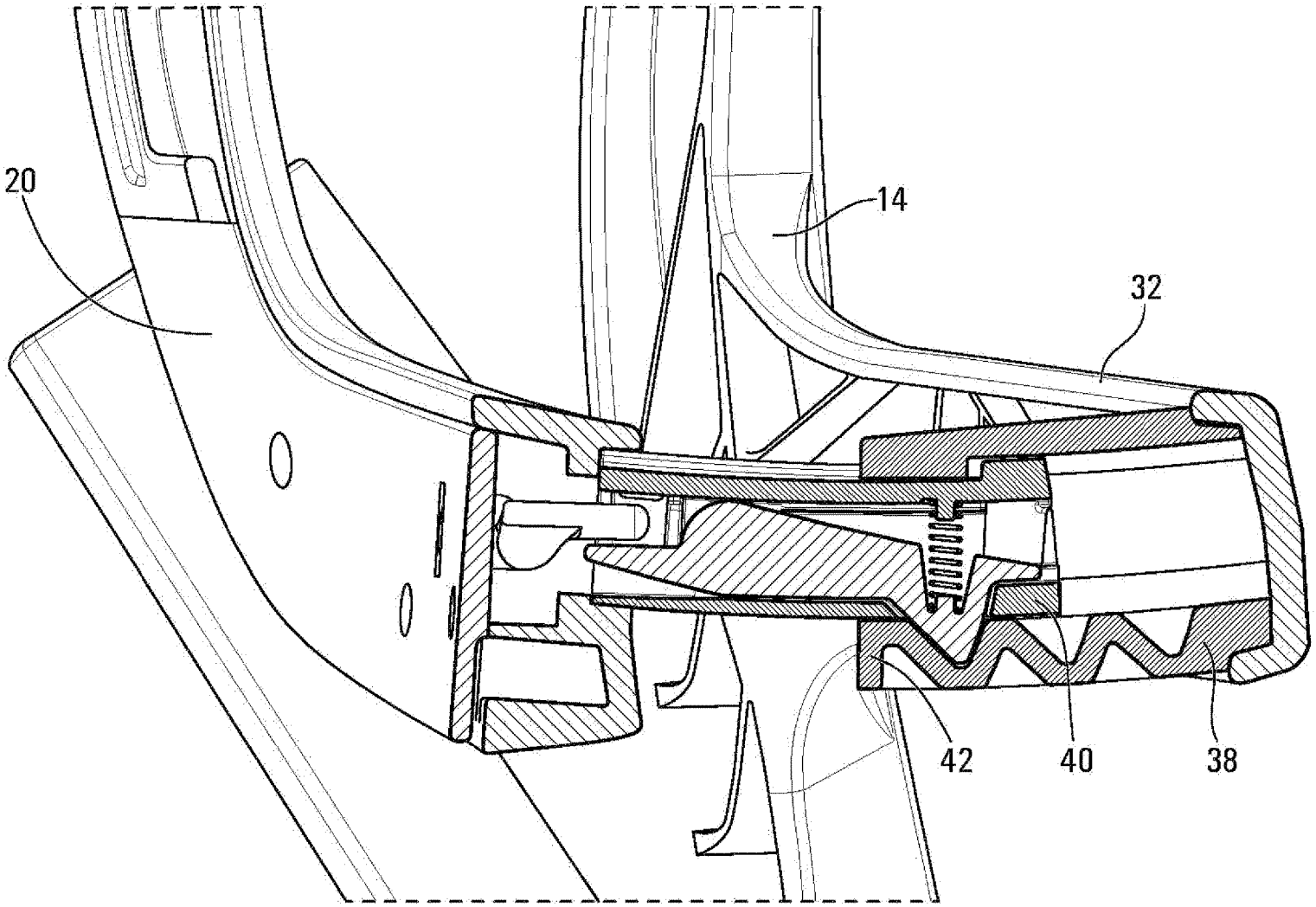
FIG. 4*d* in a cross sectional view along the lines 4-4, illustrates the back adjustment system for a chair of FIG. 1.
Figure 5:
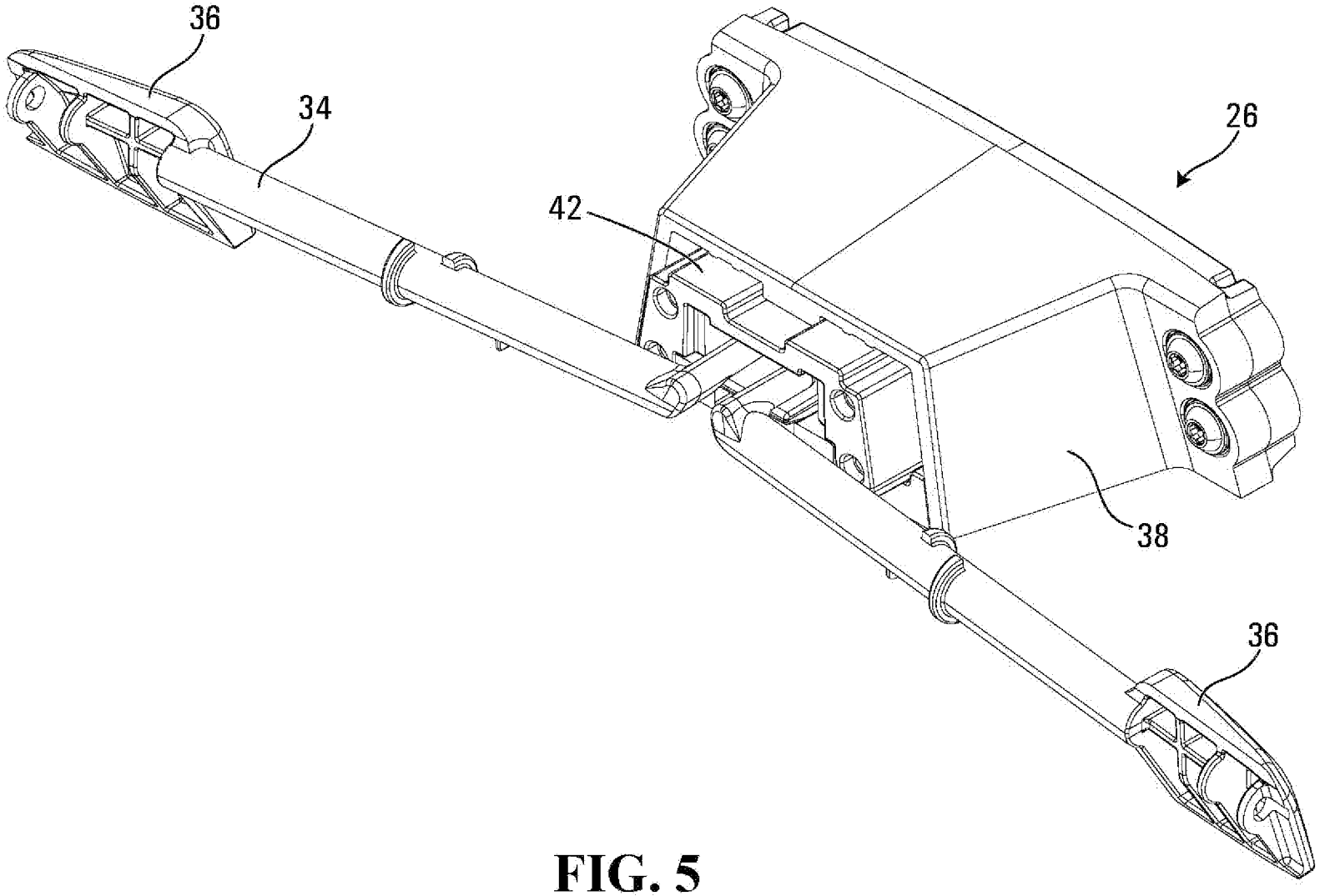
FIG. 5 in a front perspective view, illustrates the back adjustment system for a chair of FIG. 1.

Referring to FIGS. 3 to 5, the adjusting means 26 may be positioned at a mid point 32 on the bottom end 18 of the frame 14. The adjusting means 26 may further include a ratchet assembly 38 that extends from the mid point 32 of the bottom end 18 of the frame 14 outwards along a horizontal, plane. More specifically the ratchet assembly 38 has a first end 40 and second end 42. The first end 40 is mounted to the mid point 32 of the bottom end 18 of the frame 14 and the second end 42 of the ratchet assembly 38 is mounted to the second end 24 of the chair back 20. When the adjusting means 26 is engaged and the ratchet assembly 38 extends outwards, the second end 42 of the ratchet assembly 38 moves the second end 24 of the chair back 20 outwards away from the frame 14. The ratchet assembly 38 may have pre-determined steps that provide pre-determined positions for the chair back's 20 movement. The pre-determined positions reflect increasing movement of the chair back 20 away from the frame 14, thereby providing increasing back support to the user.

Figure 6:
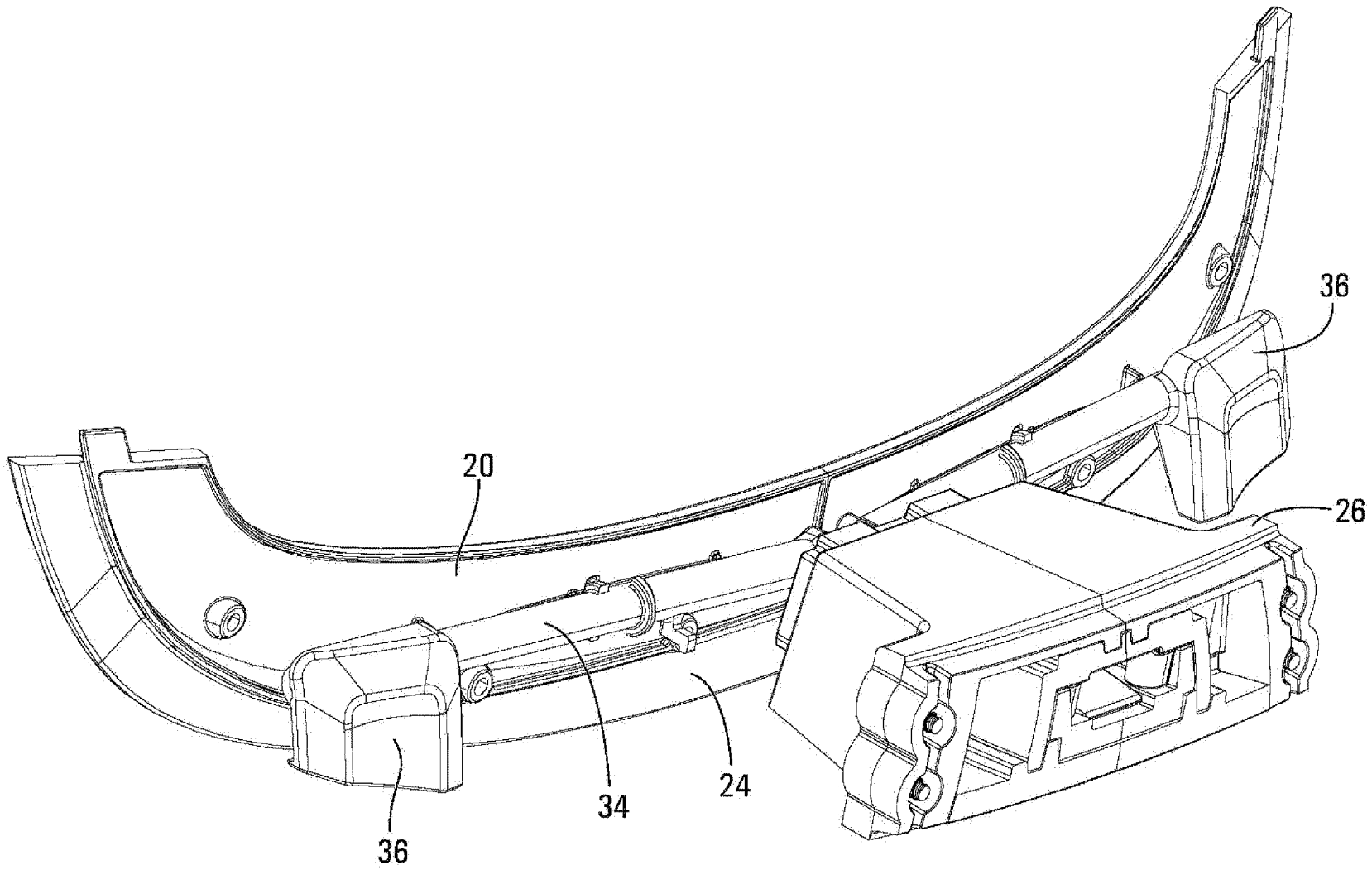
FIG. 6 in a back perspective view, illustrates the back adjustment system for a chair of FIG. 1.

Referring to FIG. 6 the adjusting means 26 may further include an adjustment mechanism 34. The adjustment mechanism 34 may include at least one push button assembly 36 positioned at the second end 42 of the ratchet assembly 38 and adapted to engage the second end 24 on the chair back 20. Conveniently a second push button assembly 36 may be included to allow for easy access to the adjusting means 26 for the adjustment of the chair back 20 from either side of the chair 12 by the user. When engaged, the push button assembly 36 releases the ratchet assembly 38 and the user can position the chair back 20 in the desired position. When the push button assembly is disengaged by the user and the ratchet assembly 38 re-engages and the chair back 20 is locked into the desired position.

Other variations and modifications of the invention are possible. All such modifications or variations are believed to be within the sphere and scope of the invention as defined by the claims appended hereto.

We claim:

1. A back adjustment system for a chair comprising:

(a) a frame including a top end and bottom end;

(b) a chair back having a first end and a second end, the first end of the chair back is mounted solely to the top end of the frame; and (c) an adjusting means mounted at a single point at the bottom end of the frame for engagement between the bottom end of the frame and the second end of the chair back;

wherein the adjusting means is positioned at a single point between the bottom end of the frame and the second end of the chair back, thereby solely moving the second end of the chair back from a retracted position to an extended position and the adjusting means is adapted to telescopically engage by pulling on the chair back away from the frame to a specified position.

2. A back adjustment system for a chair as claimed in claim 1 wherein the adjusting means further comprises an adjustment mechanism.

3. A back adjustment system for a chair as claimed in claim 2 wherein second end of the chair back has a left side and a right side and the adjustment mechanism is actuated by a least one push button positioned on either the left side or the right side of the chair of the second end on the chair back wherein the adjustment mechanism only engages when the chair back moves from the extended position to the retracted position.

4. A back adjustment system for a chair as claimed in claim 3 wherein the adjusting means further comprises a ratchet assembly.

5. A back adjustment system for a chair as claimed in claim 4 wherein the ratchet assembly is mounted to a single mid point at the bottom end of the frame and a second end of the ratchet assembly is mounted to a single mid point at the second end of the chair back.

6. A back adjustment system for a chair as claimed in claim 5 wherein the ratchet assembly further includes pre-determined steps for securing the chair back in the specified position when the chair back is pulled away from the frame.

7. A back adjustment system for a chair as claimed in claim 6 wherein the adjusting means moves the chair back in horizontal and vertical planes and in an angular pivoting motion.

* * * * *